US007931352B2

(12) United States Patent
Imamura et al.

(10) Patent No.: US 7,931,352 B2
(45) Date of Patent: Apr. 26, 2011

(54) LIQUID DISCHARGE HEAD AND METHOD FOR MANUFACTURING THE SAME

(75) Inventors: Isao Imamura, Kanagawa (JP); Hikaru Ueda, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 632 days.

(21) Appl. No.: 11/391,498

(22) Filed: Mar. 29, 2006

(65) Prior Publication Data

US 2006/0230614 A1 Oct. 19, 2006

(30) Foreign Application Priority Data

Apr. 4, 2005 (JP) ..... 2005-107449

(51) Int. Cl.
*B41J 2/135* (2006.01)
*B41J 2/14* (2006.01)

(52) U.S. Cl. ..... 347/44; 347/47

(58) Field of Classification Search ..... 347/71, 347/20, 44, 47
See application file for complete search history.

(56) References Cited

U.S. PATENT DOCUMENTS

| | | | | |
|---|---|---|---|---|
| 4,002,599 | A * | 1/1977 | Graham | 528/99 |
| 4,376,945 | A * | 3/1983 | Hara et al. | 347/67 |
| 5,479,197 | A * | 12/1995 | Fujikawa et al. | 347/63 |
| 5,557,308 | A * | 9/1996 | Chandrasekaran | 347/65 |
| 5,763,141 | A | 6/1998 | Shimomura et al. | |
| 6,123,863 | A | 9/2000 | Shimomura et al. | |
| 6,318,842 | B1 | 11/2001 | Shimomura et al. | |
| 6,659,597 | B2 * | 12/2003 | Murata et al. | 347/65 |
| 6,793,326 | B2 * | 9/2004 | Imamura et al. | 347/65 |
| 6,895,668 | B2 | 5/2005 | Iwamura | |
| 2002/0063766 | A1 * | 5/2002 | Yoshizawa et al. | 347/100 |
| 2002/0105562 | A1 * | 8/2002 | Miyagawa et al. | 347/56 |
| 2005/0078143 | A1 | 4/2005 | Shimomura et al. | |
| 2006/0221133 | A1 | 10/2006 | Harada et al. | |
| 2006/0230614 | A1 | 10/2006 | Iwamura et al. | |

FOREIGN PATENT DOCUMENTS

| | | |
|---|---|---|
| JP | 2000-68294 | 3/2000 |
| JP | 2000-80340 | 3/2000 |

* cited by examiner

*Primary Examiner* — Julian D Huffman
*Assistant Examiner* — Jason S Uhlenhake
(74) *Attorney, Agent, or Firm* — Fitzpatrick, Cella, Harper & Scinto

(57) ABSTRACT

In a method for manufacturing a liquid discharge head having a support member bonded with an adhesive to a discharge element substrate forming a discharge port for discharging a liquid, the adhesive contains a multifunctional epoxy resin of epoxy equivalent of 150 or less, a curing agent, and a mercapto silane coupling agent. The adhesive is applied to one side or both sides of junction surfaces of both members, both members of the liquid discharge head are positioned, heated and pressed, and the adhesive is cured to bond both members.

7 Claims, 6 Drawing Sheets

LIQUID DISCHARGE HEAD AND METHOD FOR MANUFACTURING THE SAME

BACKGROUND OF THE INVENTION

1. Field of the Invention

The invention relates to a liquid discharge head, and more particularly to an ink jet recording head for recording by discharging a recording liquid onto a recording medium, and a method for manufacturing the same.

2. Related Background Art

Examples of using a liquid discharge head for discharging a liquid include an ink jet recording system for recording by discharging an ink to a recording medium.

An ink jet recording apparatus used in the ink jet recording system is a recording apparatus of so-called non-impact recording system, and it is capable of recording at high speed and recording on various recording media, while generating almost no noise during recording. A typical example of ink jet recording system is a system using an electrothermal transducing element as discharge energy generating element. In the ink jet recording head of this system, the electrothermal transducing element is provided in a pressurizing compartment, and an electrical pulse is applied to it as recording signal, and thereby a thermal energy is given to the recording liquid. By using the pressure of the bubble at the time of bubbling (boiling) of recording liquid caused by phase changes of recording liquid at this time, the recording liquid is discharged.

FIG. 7 is a sectional view showing an example of mode of mounting a recording element substrate on a support member in the ink jet recording head. As shown in FIG. 7, in a discharge port plate 104 provided at the surface side of a first recording element substrate 103, a plurality of discharge ports 104*a* for discharging a recording liquid are opened at a position opposite to an energy generating element (for example, electrothermal transducing element) 105. The discharge ports 104*a* are opened in two rows, and two rows compose one set of discharge port rows. In a support member 101, recording liquid supply paths 101*a* are disposed as being separated by a partition wall 101*b*, and the support member 101 is bonded to the recording element substrate 103 at high precision. The adhesive used in bonding is, for example, a thermosetting adhesive which is cured by heat. The support member 101 is often composed of an ordinary resin formed material or a member containing such material, and hence when curing the adhesive, it is desired to be cured at a relatively low temperature. Japanese Patent Application Laid-Open Nos. 2000-80340 and 2000-68294 disclose an electrical insulating adhesive used for mounting an electronic device such as semiconductor chip on a substrate. This adhesive contains an epoxy resin of high reactivity having an epoxy equivalent of 150 or more, and is hence cured at low temperature. In the ink jet recording head manufactured by using the adhesives disclosed in these publications, the ink resistance was tested, and ink staining was grossly observed on the adhesion boundary. The reason is estimated as follows. The ink used in the ink jet recording method often contains alkaline solvent or polar solvent in order to dissolve and stabilize the dye and pigment. In the ink jet recording head using the adhesive cured at low temperature, the uncrosslinked portion not promoted completely in reaction cannot withstand the ink, possibly leading to such problem.

SUMMARY OF THE INVENTION

The present invention has been achieved in order to solve the above problems. It is an object of this invention to provide an ink jet recording head excellent in ink resistance and adhesion reliability at the junction if the adhesive is cured at relatively low temperature, and a method for manufacturing the same. In particular, it is intended to provide an adhesive having a sufficient ink resistance if an alkaline ink or an ink containing organic solvent is used.

The invention provides a liquid discharge head comprising: a discharge element substrate including a discharge port for discharging a liquid, and a supply port for supplying a liquid into the discharge port; and a support member having a supply path for supplying a liquid into the supply port, wherein the discharge element substrate and the support member are bonded by an adhesive, and the adhesive contains (A) epoxy resin, (B) curing agent, and (C) mercapto silane coupling agent, (A) contains multifunctional epoxy resin of epoxy equivalent of 150 or less, and the content of (C) in the adhesive is 2% by weight or more to 10% by weight or less of the content of (A).

The ink jet recording head of the invention is particularly useful if the member having a recording element (recording element substrate) has, for example, a cooling member containing noble metal or an ultrasonically fusible member containing noble metal. When an ultrasonically fusible member is contained, for example, at least part of the ultrasonically fusible member is the bonding side, and both members are positioned after application of the adhesive, and the both are mutually heated and pressed, and ultrasonic wave is applied, and the both members are bonded by curing the adhesive and fusing ultrasonically. In the invention, the adhesive includes both an adhesive agent applied on the bonding interface, and a sealing agent for covering the member surface for preventing contact with liquid.

In the invention, since a specific thermosetting adhesion is used, ink does not stain the adhesion interface, and an ink jet recording head having a high reliability for a long period is obtained. In particular, a combination of a specific resin such as an aminophenol type epoxy resin and a mercapto silane coupling agent is excellent in adhesion in the event of exposure to ink which is an essential characteristic of the ink jet recording head, and presents an excellent adhesion performance on inert noble metal.

DESCRIPTION OF THE PREFERRED EMBODIMENTS

Figure 1:
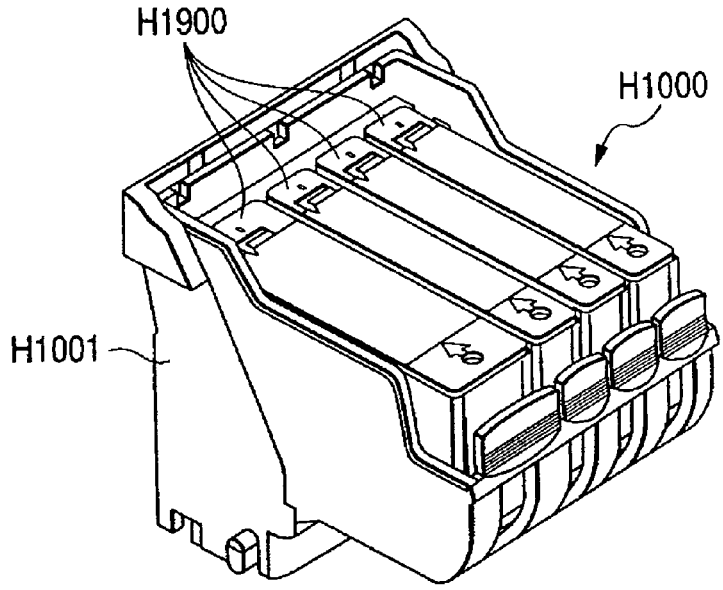
FIG. 1 is a perspective view showing combined state of recording head and ink tank in one embodiment of a recording head cartridge of the invention.

Referring now to the drawings, preferred embodiments of the invention are described specifically below. In the following description, same parts having same functions are identified with same reference numerals, and the detailed description may be not repeated.

The following description relates to an application of an ink jet recording system, the invention is not limited to this application example, but is applicable in manufacture of bio chip, electronic printed circuit, etc.

FIGS. 1 to 6E are diagrams for explaining the relation of a head cartridge, a recording head, and an ink tank according to preferred embodiments of the invention.

Figure 2:
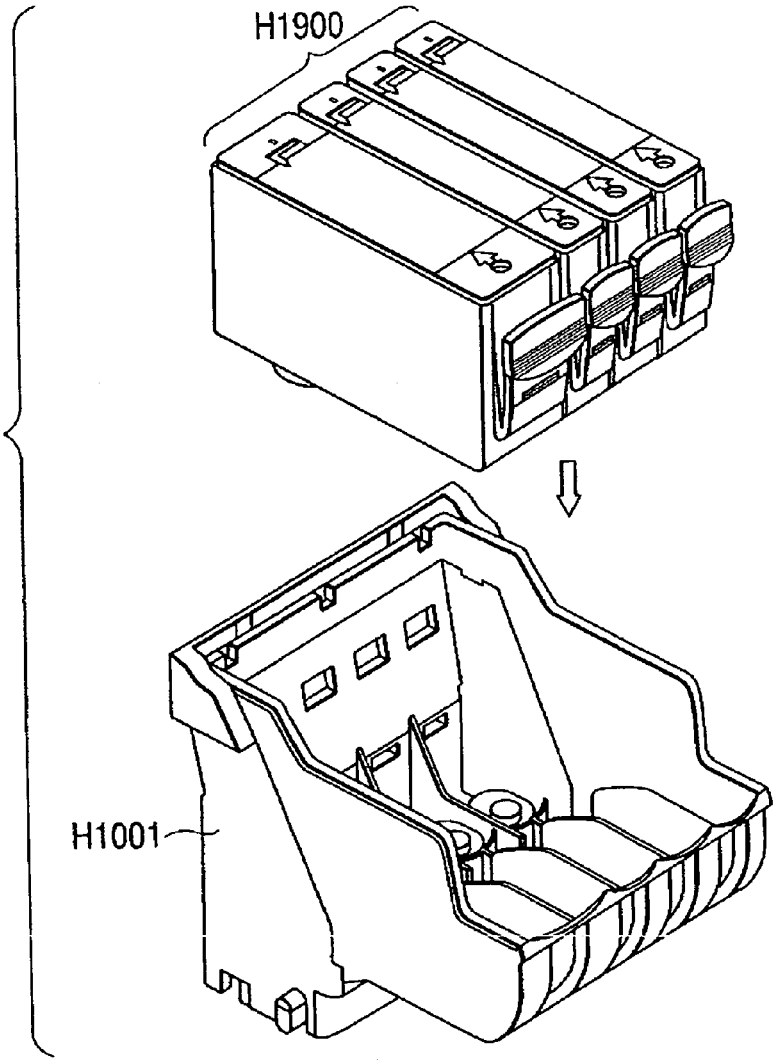
FIG. 2 is a perspective view showing separated state of recording head and ink tank in one embodiment of the recording head cartridge of the invention.

In FIGS. 1 and 2, a recording head H1001 of the invention is a constituent element for constituting a recording head cartridge H1000. The recording head cartridge H1000 is composed of the recording head H1001, and an ink tank H1900 detachably provided in the recording head H1001. The recording head cartridge H1000 is fixed and supported by positioning means and electrical contact of a carriage (not shown) mounted on an ink jet recording apparatus main body, and is detachable from the carriage.

The ink tank is not always required to be detachable from the recording head cartridge, and there is no problem if the ink tank and recording head cartridge are formed integrally.

Figure 3:
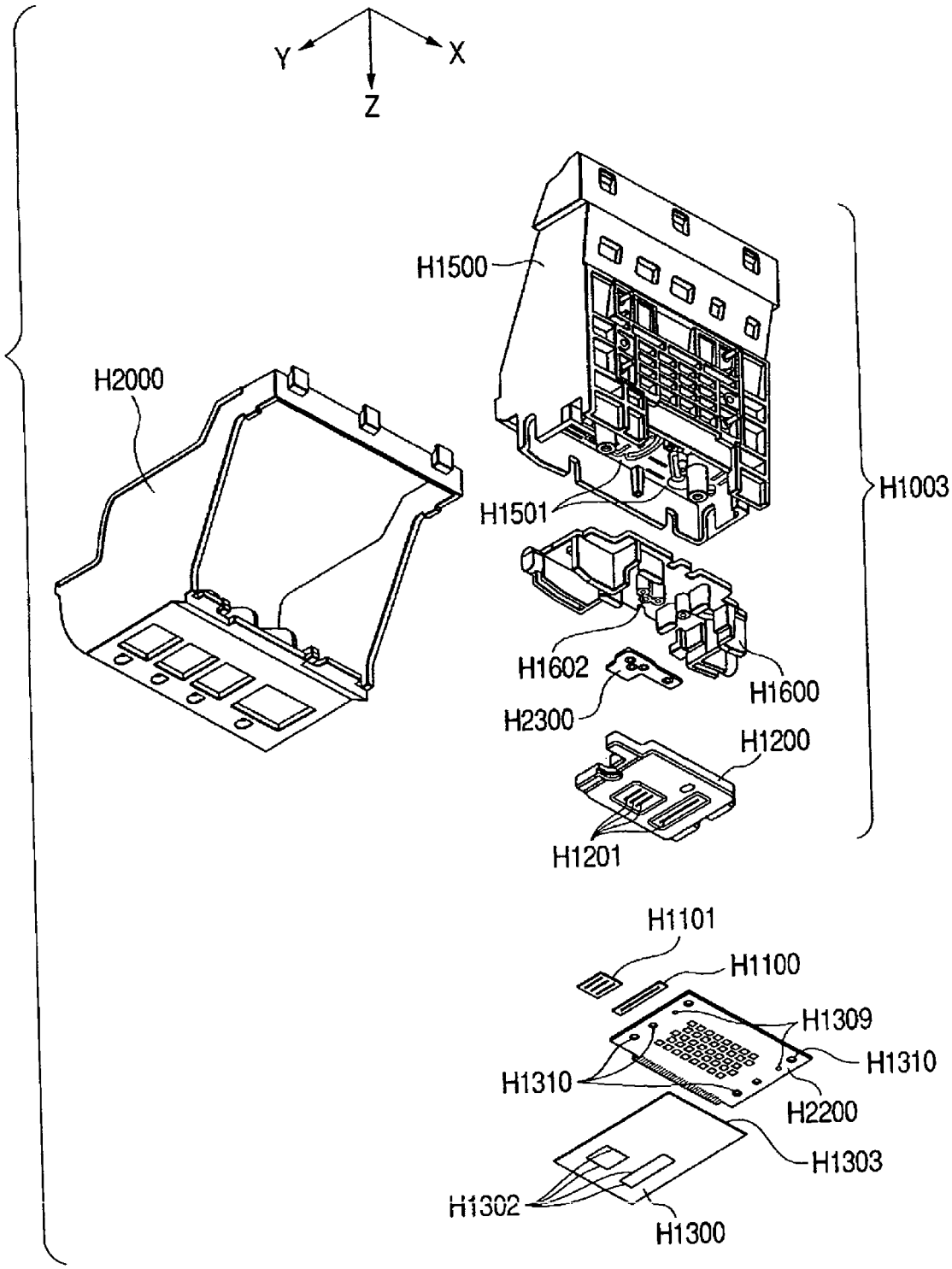
FIG. 3 is a perspective exploded view showing an ink supply unit and a recording element unit shown in FIG. 3.

As shown in a perspective exploded view in FIG. 3, the recording head H1001 includes an ink supply unit H1003, a first recording element substrate H1100, a second recording element substrate H1101, an electric wiring tape H1300, and an electric contact substrate H2200. The ink supply unit H1003 is composed of a plate H1200 as support member, an ink supply member H1500, a path forming member H1600, and a joint rubber H2300.

Figure 4:
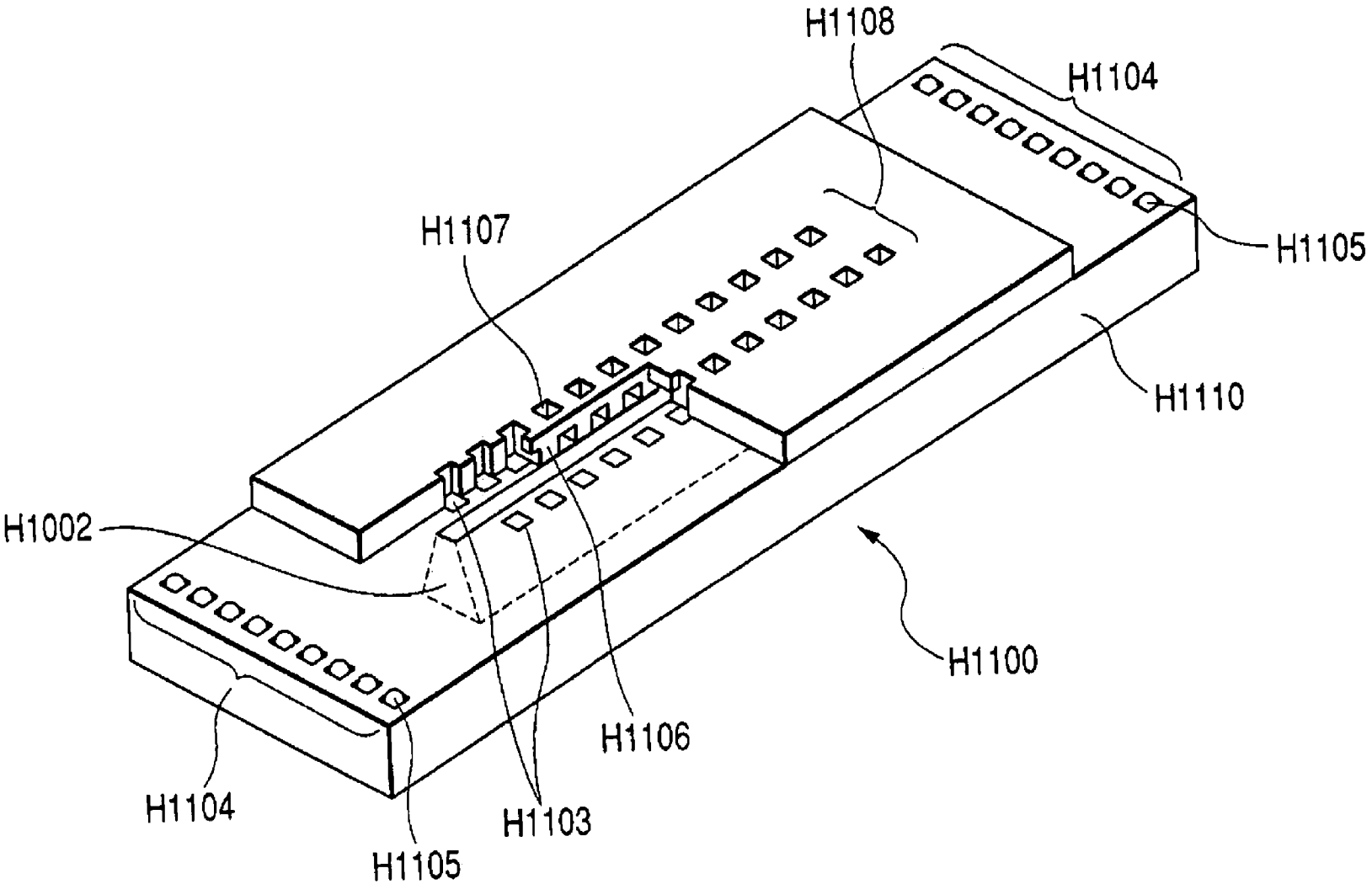
FIG. 4 is a partially cut-away perspective view showing a first recording element substrate shown in FIGS. 5A and 5B are sectional views for explaining one embodiment of a method for manufacturing an ink jet recording head of the invention.

Referring to FIG. 4, the first recording element substrate H1100 has an ink supply port H1002 of long grooved penetration opening formed, for example, in Si substrate H1110 of 0.5 to 1 mm in thickness. At both sides of it, electrothermal transducing elements H1103 are disposed in zigzag form by one row each, and the electrothermal transducing elements H1103 and Al or other electric wirings for supplying electric power to the electrothermal transducing elements H1103 are formed by film forming technology. Further, electrodes H1104 for supplying power to the electric wirings are disposed at both outer sides of the electrothermal transducing elements H1103, and Au and other bumps H1105 are formed in the electrodes H1104. On the Si substrate, an ink passage wall H1106 and a discharge port H1107 for forming an ink passage corresponding to the electrothermal transducing elements H1103 are formed of resin material by photolithography, and a discharge port row H1108 is formed. Opposite to the electrothermal transducing elements H1103, discharge ports are provided, and therefore the ink supplied from the ink passage H1102 is discharged by the bubbles generated by the electrothermal transducing elements H1103.

Refer back to FIG. 3. Members for constituting the ink supply unit including the plate H1200 as support member are bonded appropriately, and then the first recording element substrate H1100 and second recording element substrate H1101 are adhered and fixed to the plate H1200 as support member at high positioning precision. In the ink supply unit, the support member is not always required to be a separate member, but the ink supply unit may be composed to serve also as support member. The ink supply unit is usually made of thermoplastic material, and an adhesive H1202 (FIGS. 5A and 5B) used in adhesion is preferred to be low in viscosity and low in curing temperature, and to be cured in a short time. As known from the drawings, the ink passes through the plate and is supplied into the recording element substrate, and hence ink resistance is demanded at the same time. As the adhesive H1202, the thermosetting adhesive of the invention can be used preferably. Thickness of the adhesive is preferred to be 50 μm or less. In the ink supply unit, the support member is not always required to be a separate member, but the ink supply unit may be composed to serve also as support member.

The electric wiring tape H1300 applies an electric signal for discharging ink to the first recording element substrate H1100 and second recording element substrate H1101. The electric wiring tape H1300 has a plurality of openings for assembling these recording element substrates, and electrode terminals H1302 corresponding to electrodes H1104 of the individual recording element substrates. It further includes electrode terminals H1303 for connecting electrically with an electric contact substrate H2200 having an external input terminal H1301 for receiving an electric signal the apparatus main body positioned at the end of wiring tape. The electrode terminals H1302 and electrode terminals H1303 are connected through a continuous copper foil wiring pattern.

The ink is supplied in a bubbling compartment having the electrothermal transducing element H1103 and discharge port H1107, and is discharged toward the recording paper or recording medium by the thermal energy applied to the electrothermal transducing element H1103. The invention can be used in adhering position in the assembling process, and more preferably used in bonding of inorganic or metal member contacting with the ink.

Of the manufacturing process of a recording head having such structure, a step of mounting the first recording element substrate H1100 on the plate H1200 is explained below as a preferably applicable position of the adhesion in the method of the invention.

Figure 5A:
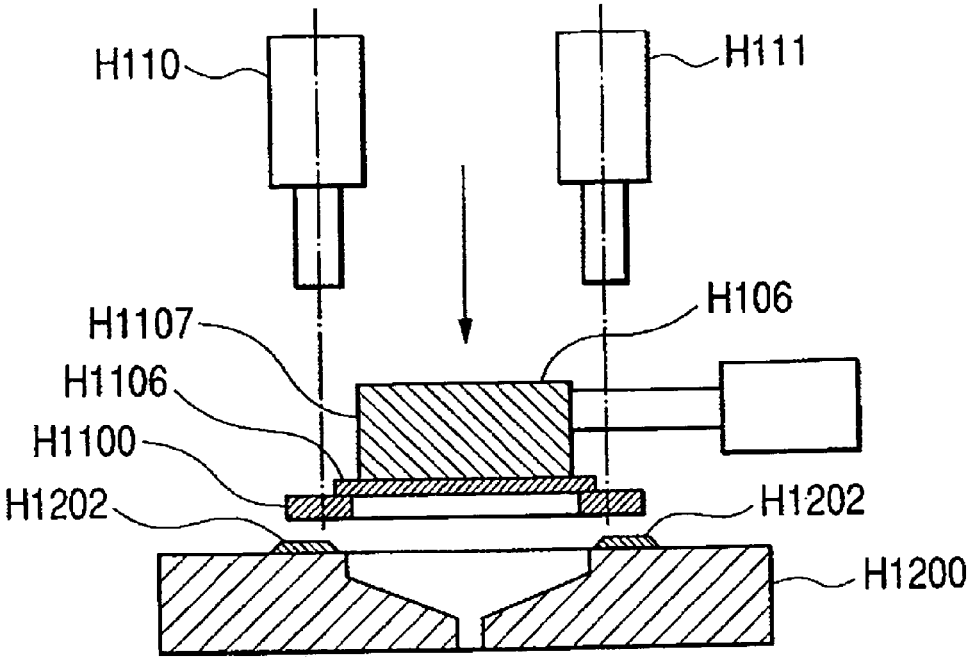
Figure 5B:
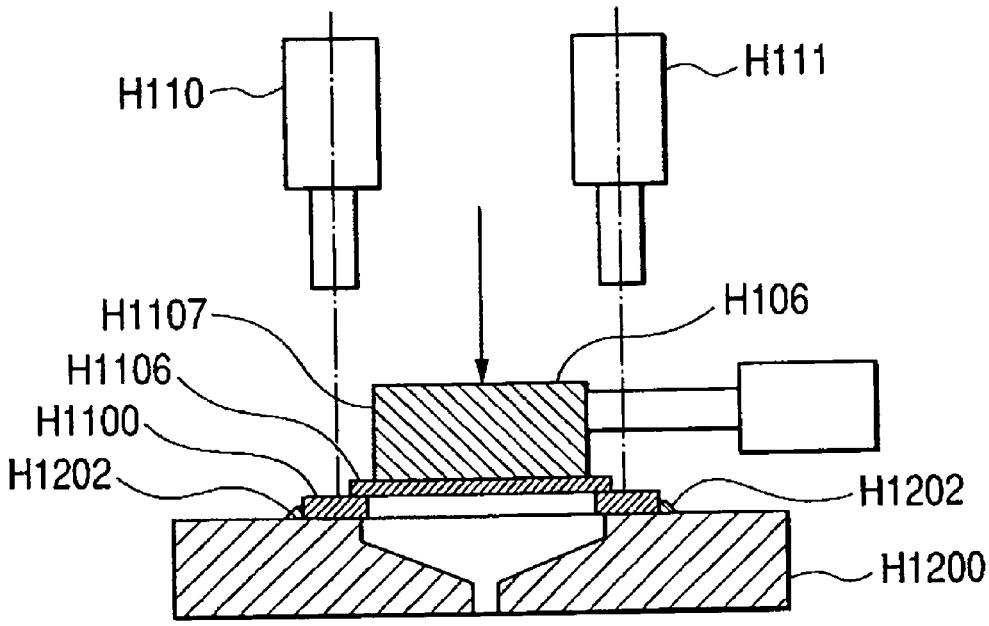

FIGS. 5A and 5B are sectional views for explaining one embodiment of the invention. FIGS. 5A to 7 are sectional views showing the first recording element substrate H1100 being cut off along the longitudinal direction of its discharge port row. In FIGS. 5A and 5B, reference numeral H106 is a vacuum suction finger for sucking and positioning the recording element substrate, and H110 and H111 are CCD cameras for recognizing the position of the recording element substrate.

As shown in FIG. 5A, the side of the ink passage wall H1106 forming the discharge port H1107 of the first recording element substrate H1100 is sucked and held by the vacuum suction finger H106. Then, by the CCD cameras H110, H111, the alignment mark (not shown) of the first recording element substrate H1100 is optically recognized, and it is positioned with the plate H1200 having an adhesive applied on an adhesion position. Successively, as shown in FIG. 5B, the positioned vacuum suction finger H106 is lowered, and the first recording element substrate H1100 is fitted to the plate H1200, and heated and pressed, and the first recording element substrate H1100 is positioned and fixed on the plate H1200. The provisionally cured component is further heated, and the adhesive H1202 is cured. Thus, in the precisely positioned state, it can be cured at a relatively low temperature, which leads to enhancement of productivity and quality.

Components of the adhesive used in the invention are described below.

Examples of multifunctional epoxy resin with epoxy equivalent of 150 or less include glycidyl amine type epoxy resin, and aminophenol type epoxy resin. Its commercial products include glycidyl amine type epoxy, Ep630 (epoxy equivalent 90 to 105, Japan Epoxy Resin Co., Ltd.), and glycidyl amine type epoxy, Ep604 (epoxy equivalent 110 to 130, Japan Epoxy Resin Co., Ltd.). Other examples include glycidyl amine type epoxy TETRAD-X (epoxy equivalent 95 to 110, Mitsubishi Gas Chemical Co., Inc.), and amino phenol type epoxy ELM-100 (epoxy equivalent 103 to 110, Sumitomo Chemical Co., Ltd.) (all of tradenames).

The blending amount of multifunctional epoxy resin of epoxy equivalent of 150 or less is preferably 10 parts by weight or more in 100 parts by weight of total amount of all resin components contained in the adhesive, variable somewhat depending on the curing agent. When the blending amount is 10 parts by weight or more, the reactivity is high, and the low temperature curing performance tends to be improved.

The multifunctional epoxy resin of epoxy equivalent of 150 or less is generally high in viscosity, and other epoxy resins may be blended as required to adjust the working efficiency, reactivity, elasticity, or glass transition point. For example, it is possible to add aromatic epoxy resin, aliphatic epoxy resin, epoxy denatured butadiene resin, polyhydric alcohol, or acid anhydride.

Examples of aromatic epoxy resin include polyhydric phenol having at least one aromatic ring, and polyglycidyl ether of its alkylene oxide adduct. Specific examples are bisphenol A, bisphenol F, and glycidyl ether of compound further adding alkylene oxide.

Examples of aliphatic epoxy resin include aliphatic polyhydric alcohol, polyglycidyl ether of its alkylene oxide adduct, and polyglycidyl ester of aliphatic long chain polybasic acid. Other examples are compound containing epoxy obtained by oxidation of aliphatic long chain unsaturated hydrocarbon by oxidizer, homopolymer of glycidyl acrylate or glycidyl methacrylate, and copolymer of glycidyl acrylate or glycidyl methacrylate. Specific examples include 1,4-butane diol diglycidyl ether, 1,6-hexane diol diglycidyl ether, triglycidyl ether of glycerin, and triglycidyl ether of trimethylol propane. Further examples include tetraglycidyl ether of sorbitol, hexaglycidyl either of dipentaerythritol, diglycidyl ether of polyethylene glycol, diglycidyl ether of polypropylene glycol, and other glycidyl ether of polyhydric alcohol. Still other examples are polyglycidyl ether of polyether polyol obtained by adding one or two or more kinds of alkylene oxide to aliphatic polyhydric alcohol of propylene glycol, glycerin and others; diglycidyl ester of aliphatic long chain dibasic acid; and others.

The curing agent is not particularly specified, but it is preferred to use others than cationic catalyst inducing hardening impedance with mercapto coupling agent. Preferred examples are amine, tertiary amine, polyamide, acid anhydride, imidazole, and phenol. Further adding epoxy resin, compounds improved in not life or reactivity may be used.

The curing agent is preferred to be capable of curing at relatively low temperature, in particular. Specific examples include triethylene tetramine, tetraethylene pentamine, other aliphatic amines and their epoxy resin adducts. Other examples include denatured aromatic amines obtained by adding glycidyl ether and other epoxy resin to aromatic amines such as methaphenylene diamine or diamino diphenyl methane. Further examples include denatured imidazole obtained by adding epoxy resin to imidazole; and imidazole compounds compounding imidazole with phthalic acid, hydroxy benzoic acid, cyano ethyl, triazine, etc. Further, imidazole may be added to dicyan diamide as curing promoter to improve low temperature curing property.

Examples of commercial products of denatured aliphatic amine include Amicure NY-24 (Ajinomoto-Fine-Techno Co., Inc.), and Novacure HX-3741 (Asahi Chemical Corporation). Commercial examples of denatured aromatic amine include Fujicure-6010 (FUJI KASEI KOGYO CO., LTD.) and Fujicure-6300 (FUJI KASEI KOGYO CO., LTD.). Examples of denatured imidazole include Amicure PN-23 (Ajinomoto-Fine-Techno Co., Inc.), and Novacure HX-3721 (Asahi Chemical Corporation) (all of tradenames). In these curing agents, as required, tertiary amine, phenol, organic acid imidazole, and other hardening promoters may be added.

The adding amount of curing agent is not particularly specified, but it is preferred to add in a range of 1 to 50 parts by weight in 100 parts by weight of the all resin components, in order to exhibit the effects of low temperature curing property, ink resistance, and adhesion strength of the resin components more effectively.

Specific examples of mercapto silane coupling include γ-mercapto propyl triethoxy silane, γ-mercapto propyl methyl dimethoxy silane, and γ-mercapto propyl trimethoxy silane. Commercial examples of them include silane coupling agent A-1891 (Japan Unica Co. Co.), and KBM-802, KBM-803 (Shin-Etsu Chemical Co., Ltd.).

The adding amount of silane coupling agent is preferred to be 2 parts by weight or more in 100 parts by weight of total resin component in consideration of contact tightness after ink immersion. The detail is described below, but if less than this content, the adhesion on the junction surface is lowered, and the ink resistance is not sufficient.

On the other hand, as for silane coupling agent, since its terminal end is coupled with the epoxy resin, an excessive addition may lead to decrease of epoxy resin which contributes to polymerization reaction in the epoxy resin, possibly leading to curing failure. This tendency is particularly notable when curing at low temperature. The inventors investigated and found that the adding amount of silane coupling is preferred to be 10 parts by weight or less in 100 parts by weight of total resin component.

In the invention, in order to improve cooling effect when recording, when forming a cooling member by bump or wiring on the reverse side of recording element substrate or when similarly forming on the plate H1200, it may seem effective to use gold in consideration of ink resistance. But gold is inert on the adhesion interface, and it is extremely difficult to obtain adhesion reliability in the presence of the ink.

However, by using an adhesive combining an epoxy resin with epoxy equivalent of 150 or less and mercapto silane coupling agent, adhesion reliability in ink immersion can be obtained. This is specifically described below by referring to the drawings.

Figure 6A:
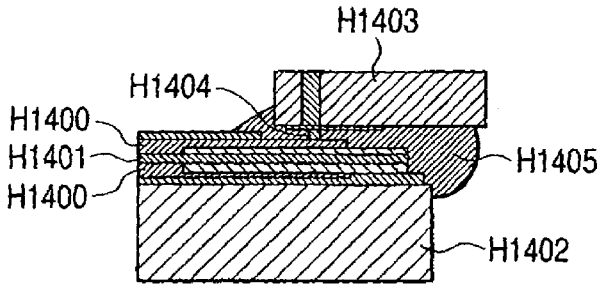
FIGS. 6A, 6B, 6C, 6D and 6E are sectional views for explaining one embodiment of a method for manufacturing the ink jet recording head of the invention.
Figure 7:
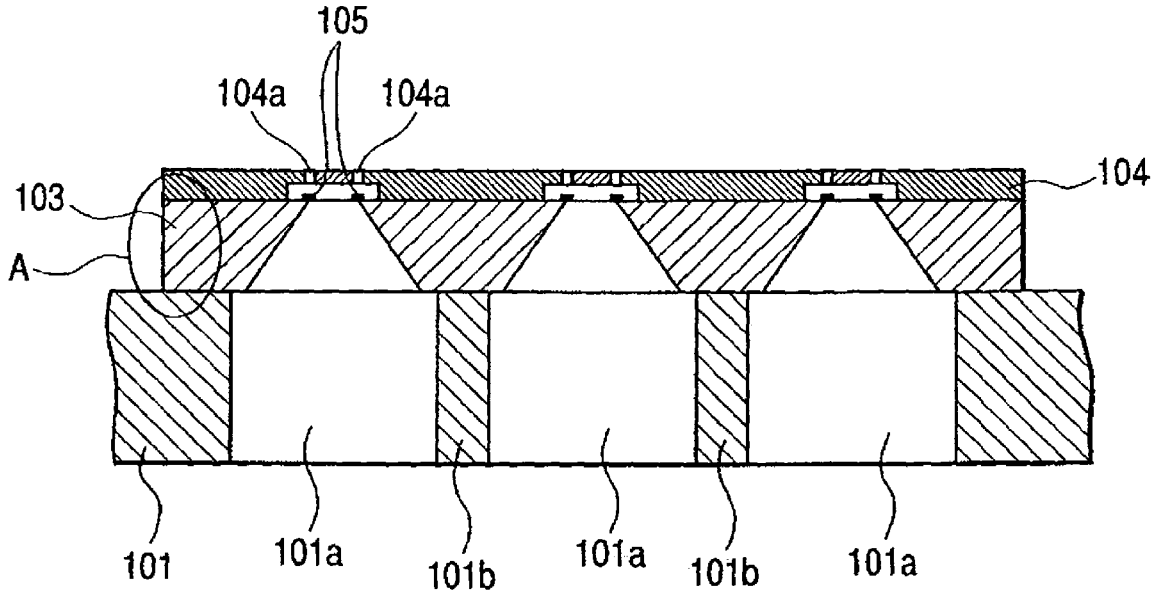
FIG. 7 is a sectional view showing an example of mounting of a recording element substrate on a support member.

FIG. 6A is a schematic sectional view showing a second embodiment of the invention, being a magnified view at a position of round frame A in FIG. 7. In FIG. 6A, a recording element substrate H1403 is provided on an electric wiring tape H1401 formed integrally with an indicating member H1402, and a gold electrode H1404 is provided on the recording element substrate H1403 so as to penetrate through the recording element substrate H1403. On the reverse side of the recording element substrate H1403, the electrode is electrically connected to a gold plated layer H1400 provided on the wiring tape H1401 formed at the side of the recording element substrate H1403. At the time of recording, the heat generated from the electrothermal transducing element is transmitted from the electrode H1404 to the gold plating H1400 of the wiring tape H1401 and is released.

Figure 6D:
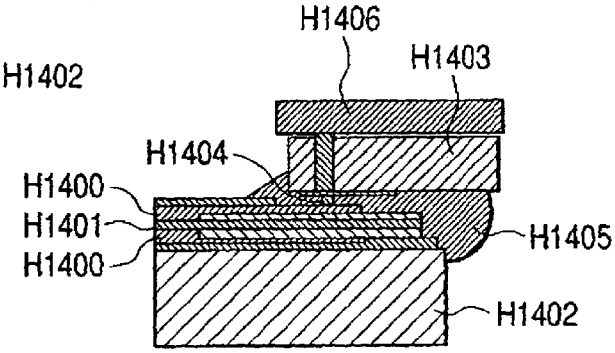
Figure 6B:
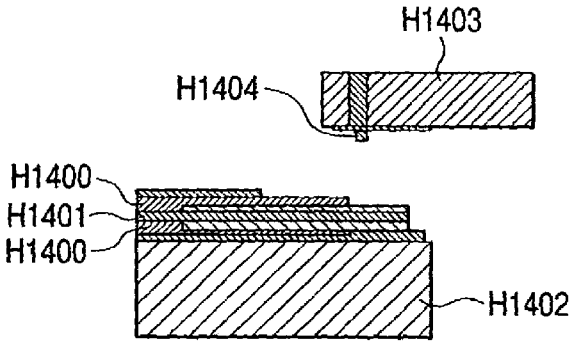
Figure 6E:
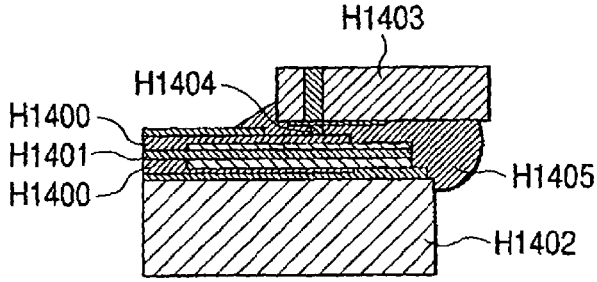
Figure 6C:
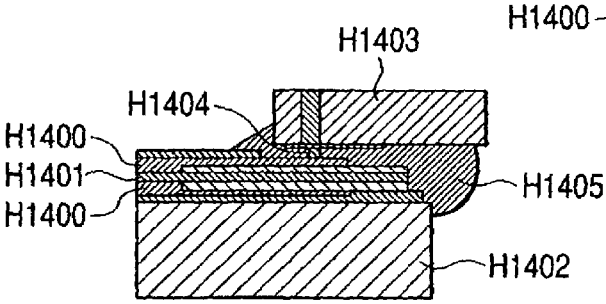

The bonding process is explained. FIG. 6B shows a step before bonding. As shown in FIG. 6C, successively, the recording element substrate H1403 on which an adhesive is applied and the indicating member H1402 are brought into contact with the gold electrode H1404 and gold plating H1400, and are positioned. Next, as shown in FIG. 6D, by heating and pressing by using a heat tool H1406, the adhesive H1405 is cured provisionally, and ultrasonic waves are applied, and the electrode H1404 and gold plating H1400 are fused. Finally, as shown in FIG. 6E, the adhesive H1405 is cured finally, and bonding is completed.

Members plated by noble metal can be fixed, for example, by ultrasonic fusion, but the junction must be sealed in order to protect from ink, and the adhesive of the invention can be used for this purpose.

The sectional view shows an example of mounting an element substrate on a support member.

EXAMPLE

The invention is further described below by presenting an example.

Adhesives of experiment Nos. 1 to 10 in the composition shown in Table 1 were prepared. Experiment Nos. 1, 2 and 5 to 9 are examples of the invention, and experiment Nos. 3, 4 and 10 are comparative examples.

Of experiment Nos. 1, 2 and 5 to 9 of the invention, experiment No. 1 is a representative example. Experiment No. 2 is an example of changing the type of mercapto silane coupling agent. Experiment Nos. 5 and 6 are examples of changing the content of mercapto silane coupling agent, and experiment Nos. 7 to 9 are examples of changing the type of epoxy resin or curing agent.

Of experiment Nos. 3, 4 and 10 of comparative examples, experiment Nos. 3 and 4 are examples of using ordinary epoxy or amine silane coupling agents instead of the mercapto silane coupling agents in experiment No. 1. Experiment No. 10 is an example of using only ordinary bifunctional epoxy resin as resin component, without using multifunctional epoxy resin of epoxy equivalent of 150 or less.

TABLE 1

| | | Experiment No. | | | | | | | | | |
|---|---|---|---|---|---|---|---|---|---|---|---|
| | | 1 | 2 | 3 | 4 | 5 | 6 | 7 | 8 | 9 | 10 |
| Multi-functional epoxy of epoxy equivalent of 150 or less | ELM-100*1 (epoxy equivalent 103 to 110) | 30 | 30 | 30 | 30 | 30 | 30 | | | 30 | |
| | ELM-604*2 (epoxy equivalent 110 to 130) | | | | | | | 30 | 30 | | |
| Other epoxy resin | Adecaoptomer KRM2419*3 (epoxy equivalent 184 to 194) | 70 | 70 | 70 | 70 | 70 | 70 | | | 20 | 100 |
| | Epicoat 807*4 (epoxy equivalent 160 to 175) | | | | | | | 70 | 70 | 20 | |
| | Epicoat 1001*5 (epoxy equivalent 450 to 500) | | | | | | | | | 20 | |
| Curing agent | Fujicure-6010*5 (epoxy added denatured aromatic amine) | | | | | | | | 50 | | |
| | DICY7*7 (dicyan diamide) | 6 | 6 | 6 | 6 | 6 | 6 | 6 | | 6 | 6 |
| | 1,2-dimethyl imidazole (imidazole) | 10 | 10 | 10 | 10 | 10 | 10 | 10 | | 10 | 10 |
| Silane coupling agent | Silane coupling agent A-1891*8 (mercapto) | 3 | | | | 2 | 1 | 3 | 5 | 3 | 5 |
| | KBM-802*9 (mercapto) | | 3 | | | | | | | | |
| | Silane coupling agent A-187*10 (epoxy) | | | 3 | | | | | | | |
| | Silane coupling agent A-1100*11 (amine) | | | | 3 | | | | | | |

TABLE 1-continued

| | Experiment No. | | | | | | | | | |
|---|---|---|---|---|---|---|---|---|---|---|
| | 1 | 2 | 3 | 4 | 5 | 6 | 7 | 8 | 9 | 10 |
| Fixing performance | A | A | A | A | A | A | A | A | A | B |
| Ink immersion test | C | D | F | F | D | E | D | D | | F |

*1ELM-100 (epoxy equivalent 103 to 110), tradename of Sumitomo Chemical Co., Ltd., aminophenol epoxy
*2Ep-604 (epoxy equivalent 110 to 130), tradename of Japan Epoxy Resin Co., Ltd., glycidylamine epoxy
*3Adecaoptomer KRM2410 (epoxy equivalent 184 to 194), tradename of Asahi Denka Co., Ltd., bisphenol A epoxy
*4Epicoat 807 (epoxy equivalent 160 to 175), tradename of Japan Epoxy Resin Co., Ltd., bisphenol F epoxy
*5Epicoat 1001 (epoxy equivalent 450 to 500), tradename of Japan Epoxy Resin Co., Ltd., solid bisphenol A epoxy
*6Fujicure 6010 (epoxy added denatured aromatic amine), tradename of FUJI KASEI KOGYO CO., LTD.
*7DICY7 (dicyan diamide), tradename of Japan Epoxy Resin Co., Ltd.
*8Silane coupling agent A-1891 (mercapto silane coupling agent), tradename of Japan Unica Co.
*9Silane coupling agent A-187 (epoxy), tradename of Shin-Etsu Chemical Co., Ltd.
*10KBM-802 (mercapto silane coupling agent), tradename of Japan Unica Co.
*11Silane coupling agent A-1100 (epoxy silane coupling agent), tradename of Japan Unica Co.

(Evaluation)

[Fixing Performance]

A: work is fixed in 30 seconds at 150° C.

B: work is not fixed in 30 seconds at 150° C.

[Ink Immersion Test]

C: no change after ink immersion and storage.

D: slight stain of ink in adhesion interface after ink immersion and storage.

E: stain of ink after ink immersion and storage.

F: stain of ink with partial peeling after ink immersion and storage.

Using these adhesives, provisional bonding (30 seconds at 150° C.) was tested according to the process explained in FIGS. 5A and 5B. Provisional bonding was evaluated as fixing performance, and rated as "A" when the work was fixed in 30 seconds at 150° C., and "B" when not fixed as shown in Table 1. In the composition of experiment No. 10 (comparative example), since multifunctional epoxy resin of epoxy equivalent of 150 or less was not contained, the reaction was slow, and the work was not fixed in this condition. In experiments No. 1 to No. 9, on the other hand, since multifunctional epoxy resin of epoxy equivalent of 150 or less of quick response was blended, there was no problem in provisional bonding.

After provisional curing, the work was further heated for 60 minutes at 100° C., and the adhesive H1202 was cured. The finished element was assembled in an ink jet printing head in the method described above. This recording head was immersed in black ink in ink jet printer BJF8500 manufactured by Canon Inc., and stored for 3 months at 60° C. and observed. The ink immersion test was evaluated as "C" if there is no change after ink immersion and storage, "D" if there is slight stain of ink in adhesion interface, "E" if there is stain of ink, and "F" if there is stain of ink with partial peeling, as shown in Table 1.

As a result, of experiments No. 1 to No. 10, Nos. 3, 4 and 10 of comparative examples disclosed permeation of ink in the adhesive and peeling in the recording element substrate H1100 composed of plate H1200 of first alumina and first Si substrate.

Such problems were not observed in the examples of the invention, Nos. 1, 2, and 5 to 9. There was a slight difference in degree among Nos. 1, 2, and 5 to 9. In experiment Nos. 1 and 9, the multifunctional epoxy resin is amino phenol epoxy resin, and the mercapto silane coupling agent is γ-mercapto propyl triethoxy silane, the results were excellent with no ink stain at all in the adhesion interface if immersed in ink for a long period. In experiment Nos. 2, 5, 7, and 8, slight ink stain was observed, but there was no peeling, and discharge was favorable. Thus, in these examples, ink resistance can be expressed at a relatively low temperature, and dimensional stability of the ink jet recording head is improved, and hence the scope of selection of materials for constituting the ink jet recording head is expanded.

The application range of the adhesive of the invention is not limited to the positions indicated in the examples, but may include all possible positions contacting with the ink in the assembling process of the ink jet recording head, in which its characteristic may be utilized effectively.

This application claims priority from Japanese Patent Application No. 2005-107449 filed on Apr. 4, 2005, which is hereby incorporated by reference herein.

What is claimed is:

1. A liquid discharge head comprising:

a discharge element substrate having a discharge port for discharging a liquid, an energy generating element for generating discharging energy to discharge liquid from the discharge port and provided at a first surface of the substrate, and a supply port for supplying liquid to the discharge port penetrating between the first surface and a second surface of the substrate, the second surface being a back surface of the first surface; and a support member for supporting the discharge element substrate and having a supply path for communicating with the supply port, wherein the second surface of the discharge element substrate and the support member are bonded by an adhesive, and the adhesive contains:

(A) a glycidyl amine type epoxy resin containing multifunctional epoxy resin of epoxy equivalent of not more than 150, (B) a dicyandiamide and an imidazole compound, and (C) a mercapto silane coupling agent.

2. The liquid discharge head according to claim 1, wherein (C) is γ-mercapto propyl ethoxy silane.

3. The liquid discharge head according to claim 1, wherein the multifunctional epoxy resin has epoxy equivalent of 130 or less.

4. The liquid discharge head according to claim 3, wherein the multifunctional epoxy resin has epoxy equivalent of from 90 to 130.

5. The liquid discharge head according to claim 1, wherein the content of (C) in the adhesive is 2% by weight or more to 10% by weight or less of the content of (A).

6. The liquid discharge head according to claim 1, wherein the discharge element substrate has an electrode of noble metal electrically connected to the energy generating element and provided at the second surface of the discharge element substrate, and the adhesive seals a part of the electrode.

7. The liquid discharge head according to claim 1, wherein the imidazole compound is 1,2-dimethyl imidazole.

* * * * *